US010032361B2

(12) United States Patent
Chadwick et al.

(10) Patent No.: US 10,032,361 B2
(45) Date of Patent: Jul. 24, 2018

(54) THREAT MONITORING FOR CROWD ENVIRONMENTS WITH SWARM ANALYTICS

(71) Applicant: Intel Corporation, Santa Clara, CA (US)

(72) Inventors: Stephen C. Chadwick, Chandler, AZ (US); Cory R. Zorker, Chandler, AZ (US); Brian W. McCann, Gilbert, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/191,167

(22) Filed: Jun. 23, 2016

(65) Prior Publication Data

US 2017/0372593 A1 Dec. 28, 2017

(51) Int. Cl.
*G08B 27/00* (2006.01)
*G08B 25/10* (2006.01)

(52) U.S. Cl.
CPC ..... *G08B 27/00* (2013.01); *G08B 25/10* (2013.01)

(58) Field of Classification Search
CPC ..... G08B 27/00; G08B 27/001–27/008; G08B 25/016; G08B 25/10; H04W 4/22; H04W 4/90; H04N 7/181; G01S 13/878; G01S 5/02

See application file for complete search history.

(56) References Cited

U.S. PATENT DOCUMENTS 8,422,986 B1 * 4/2013 Martin ..... H04M 11/04 370/338
8,879,540 B1 * 11/2014 Martin ..... H04W 4/023 370/352
2011/0046920 A1 * 2/2011 Amis ..... G01S 19/16 702/181
2011/0105084 A1 * 5/2011 Chandrasekaran ... H04L 63/107 455/411
2013/0109427 A1 * 5/2013 Matus ..... G08B 21/025 455/521
2013/0305369 A1 * 11/2013 Karta ..... H04L 63/1416 726/23
2013/0307972 A1 * 11/2013 Stone ..... H04N 7/181 348/143
2013/0307980 A1 * 11/2013 Stone ..... H04N 7/185 348/148
2013/0307989 A1 * 11/2013 Stone ..... H04N 7/181 348/159

(Continued)

*Primary Examiner* — Orlando Bousono
(74) *Attorney, Agent, or Firm* — Compass IP Law PC

(57) ABSTRACT

A system enables threat monitoring in a school or other "crowd" environment. The premises where the crowd environment will exist includes one or more nodes that can gather realtime location data for multiple mobile devices. The system includes off-premises processing such as a data center, or an on-premises server, or both. The processing receives the realtime location data from the one or more nodes and performs swarm analytics processing on the data. The swarm analytics processing can determine if movement patterns indicated by the location data indicate a likely threat condition for the crowd. The system notifies a first responder of the threat condition. The system can optionally notify the users of the mobile devices as well.

18 Claims, 10 Drawing Sheets

(56) References Cited

U.S. PATENT DOCUMENTS

2013/0312043 A1* 11/2013 Stone ..... H04W 4/006 725/62
2014/0063237 A1* 3/2014 Stone ..... H04N 7/181 348/143
2014/0066089 A1* 3/2014 Monks ..... H04W 4/22 455/456.1
2014/0134971 A1* 5/2014 Monks ..... H04W 4/22 455/404.2
2014/0241334 A1* 8/2014 Martin ..... H04W 4/22 370/338
2015/0070506 A1* 3/2015 Chattopadhyay .. G06K 9/00718 348/159
2015/0097667 A1* 4/2015 Cruse ..... G08B 25/016 340/539.11
2015/0128274 A1* 5/2015 Giokas ..... H04L 63/1425 726/23
2015/0249685 A1* 9/2015 Crane ..... H04L 63/20 726/1
2015/0365246 A1* 12/2015 Kane ..... H04L 12/1895 709/203
2016/0072770 A1* 3/2016 Crane ..... H04L 63/0281 726/22
2016/0100301 A1* 4/2016 Gaurav ..... H04W 4/22 455/404.2
2016/0119424 A1* 4/2016 Kane ..... G08B 27/001 709/203
2016/0232777 A1* 8/2016 Jedwab ..... G08B 25/001
2016/0306979 A1* 10/2016 Kotler ..... G06F 21/577
2016/0306980 A1* 10/2016 Kotler ..... G06F 21/577
2016/0308895 A1* 10/2016 Kotler ..... H04L 63/1433

* cited by examiner

THREAT MONITORING FOR CROWD ENVIRONMENTS WITH SWARM ANALYTICS

FIELD

Descriptions are generally related to monitoring network systems, and more particular descriptions are related to crowd monitoring.

COPYRIGHT NOTICE/PERMISSION

Portions of the disclosure of this patent document may contain material that is subject to copyright protection. The copyright owner has no objection to the reproduction by anyone of the patent document or the patent disclosure as it appears in the Patent and Trademark Office patent file or records, but otherwise reserves all copyright rights whatsoever. The copyright notice applies to all data as described below, and in the accompanying drawings hereto, as well as to any software described below: Copyright© 2016, Intel Corporation, All Rights Reserved.

BACKGROUND

As a society, we gather in public places with many people, such as schools and public shopping areas. A troubling trend that has developed is that people intending harm come into public places to cause acts of violence. When such a threat condition occurs, first responders come as quickly as they are able, but they are faced with a rapidly changing environment in response to the threat. Police are not always certain where a threat is located, and try to quickly assess the situation. Any delay in response may cost additional lives, but if the response is uncoordinated the first responder resources may be dispatched to the incorrect location, again resulting in a delayed response.

BRIEF DESCRIPTION OF THE DRAWINGS

The following description includes discussion of figures having illustrations given by way of example of implementations of embodiments of the invention. The drawings should be understood by way of example, and not by way of limitation. As used herein, references to one or more "embodiments" are to be understood as describing a particular feature, structure, and/or characteristic included in at least one implementation of the invention. Thus, phrases such as "in one embodiment" or "in an alternate embodiment" appearing herein describe various embodiments and implementations of the invention, and do not necessarily all refer to the same embodiment. However, they are also not necessarily mutually exclusive.

Descriptions of certain details and implementations follow, including a description of the figures, which may depict some or all of the embodiments described below, as well as discussing other potential embodiments or implementations of the inventive concepts presented herein.

DETAILED DESCRIPTION

As described herein, a threat monitoring system enables threat detection in a "crowd" environment based on swarm analytics processing of location data. The crowd environment includes any public place with a lot of people, such as a school, public shopping area, event, or other environment where people gather in large groups. From the perspective of the crowd, a significant number of individuals or most of them will have a mobile device. When faced with a threat, people tend to move away from the threat, which is movement that can be detected by location services of the mobile devices. The mobile device movement information can act as a threat indication sensor on the premises where the crowd environment will exist. Thus, multiple mobile devices providing movement information can act as a swarm of threat indication sensors, or a randomly-distributed, many-sensor network. The premises can include one or more nodes that gather realtime location data for the mobile devices. The threat monitoring system includes off-premises processing such as a data center, or an on-premises server, or both. The processing receives the realtime location data from the one or more nodes and performs swarm analytics processing on the data. The swarm analytics processing can determine if movement patterns indicated by the location data indicate a likely threat condition for the crowd. The system notifies a first responder of the threat condition. The system can optionally notify the users of the mobile devices as well.

While it would clearly be preferable not to have the threat conditions in the first place, with the threat detection information first responders faced with a dynamic environment will also have information that can help them more quickly assess the situation. In one embodiment, the system can calculate a likely location of the threat, as well as a likely location of one or more victims. The system can provide such information to first responders, enabling them to coordinate the response to the situation and dispatch resources to the most needed areas quickest. The system can push the information to first responders via mobile phones or tablets of the first responders, enabling them to have detailed location data about the situation. Such location data can enable them to more quickly contain the threat and find groups of individuals closest to the danger that can be more quickly protected.

Figure 1:
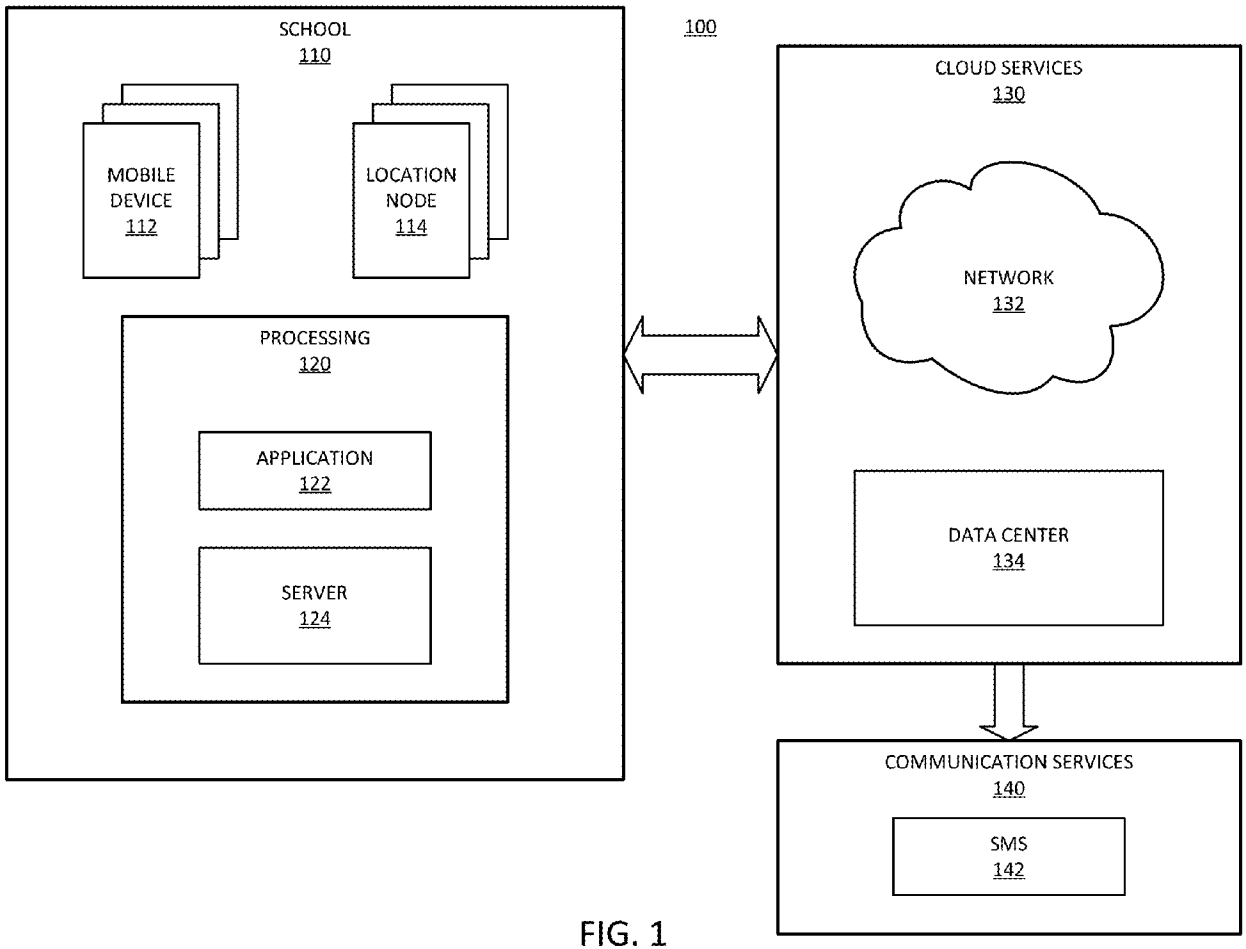
FIG. 1 is a block diagram of an embodiment of a system that performs threat monitoring.

FIG. 1 is a block diagram of an embodiment of a system that performs threat monitoring. System 100 represents a threat monitoring system for a school environment. While system 100 is indicated as a school environment, it will be understood that any other public venue with crowds of people can employ the same or similar threat monitoring system. While the following description of system 100 makes reference to a school environment, those of skill in the art will appreciate how to apply the system to other environments.

School environment 110 represents the school setting. In a school setting, many students have mobile devices that have location services enabled with the cellular carrier. In one embodiment, system 100 utilizes the location services of the cellular carrier. In one embodiment, school environment 110 includes a network setup to monitor and record the location of students over time. For example, school environment 110 is illustrating including multiple location nodes 114, which can be wireless access points or other location sensors spread throughout the school. Location nodes 114 can be referred to as data nodes because they gather data. The data nodes monitor the location information provided by mobile devices 112, which enables system 100 to analyze general trends of movement. It is understood that location tracking relates to privacy concerns, which can be addressed in system 100 at least two ways. A first way is that system 100 can be effective at monitoring threat conditions simply by having "trend" information about movements of the crowd. Thus, anonymized location data can be used by providing a hash tag or other anonymized representation to each individual mobile device 112. Such a representation can even be changed each time the student enters the school. Another way to reduce privacy concerns is to allow an opt-in model. While more data may provide more accurate results, it is expected that opt-in participation can provide enough information to identify general crowd movement patterns needed to assess a threat condition.

In the case of a threat, crowds respond in expected patterns. People far enough away from the threat will tend to increase their distance even further from the threat. People who are unable to move away from the threat will generally remain stationary or localized as they try to barricade themselves away from the threat. Those in imminent danger may engage the threat directly. In one embodiment, location nodes 114 or cell phone towers, or a combination, record the location of mobile devices 112 over time and provide the data to one or more processing nodes. The processing nodes can include local processing resources as represented by processing node 120, or remote processing resources as illustrated by data center 134 of cloud services 130, or a combination of local and remote processing. The processing resources can receive and store the location data, and process the data to identify movement patterns in the crowd or groups of people.

In one embodiment, school environment 110 includes processing resources 120, which include server 124 and application 122. Server 124 represents one or more computer devices to execute operations to perform one or more calculations. Application 122 represents code or services to be executed by server 124 to enable processing node 120 to participate in threat monitoring. In one embodiment, application 124 includes a service to receive data from location nodes 114 and aggregate the data. In one embodiment, location nodes 114 provide indoor location services, for example, by allowing the triangulation of a mobile device 112 based on relative signal strength with respect to multiple location nodes 114. The computational resources to perform such triangulation can be kept at location nodes 114. In one embodiment, application 122 and server 124 represent computation resources to perform indoor location services via signals provided and received by location nodes 114. In one embodiment, application 122 receives GPS (global positioning system) information from mobile devices 112 via location nodes 114.

In one embodiment, on-site processing node 120 can perform most or all of the computations for data processing to determine a threat condition. In one embodiment, on-site processing node 120 performs some processing and forwards data to data center 134 over network 132 to perform the rest of the processing. In one embodiment, data center 134 performs swarm analytics on data gathered by location nodes 114 and collected and sent by processing node 120. It will be understood that processing node 120 could include the computational resources to perform swarm analytics in one embodiment, but such computations tend to be resource-intensive and would require a significant amount of processing resources to make decisions in realtime. Thus, such computations would typically be provided by cloud services 130.

Network 132 represents one or more networks that interconnect school 110 to data center 134. Whether solely with on-site server resources 124, or by data center 134, or with a combination, system 100 can record and analyze location data from mobile devices 112. The processing node or processing nodes represented by the processing resources of system 100 include swarm analytics processing to analyze the data based on movement patterns or movement trends that can be extracted from the location data. Whether processed on-site or off-site from school 110, or the premises where the crowd is located, cloud services 130 or other network services can connect to communication services 140 to provide the threat condition information to first responders. In one embodiment, communication services 140 include SMS (short message service) 142 to enable communication via cellular networks.

In one embodiment, communication services 140 secures a data feed about the threat condition. For example, communication services can protect the data and only make it available to the first responders based on school 110 triggering an "event." For example, the data can indicate a threat condition that is not reported to first responders until an administrator at the school identifies a threat event. In one embodiment, the threat event is triggered by preconfigured equipment, or by a mobile device application service, or by receipt of an emergency call for a location of school 110. Once the threat event is indicated, system 100 can trigger data availability through a secured application for first responders. A secured application can include a password or biometric scan of known first responders, or other protection.

In one embodiment, communication services 140 include the capability not only to provide data to first responders, but to provide notification to system "participants." In one embodiment, every student who opts in to the system is a participant, and can receive threat notifications. In one embodiment, students who are not on campus can still be notified of the threat condition. Similarly, parents and administrators can also be system participants, and receive realtime notification of the threat condition. Such pushing of notification information enables system 100 to reduce the number of people involved in an incident. Such push notifications can also disperse information on how to make arrangements to locate children, which can provide at least some measure of order to a chaotic situation.

It will be understood that system 100 provide a very simplified architecture of how a threat monitoring system can be implemented. In one embodiment, location nodes 114 gather GPS and indoor location services for mobile devices 112. In one embodiment, on-site processing 120 can gather the data and provide it via network 132 to data center 134. In one embodiment, when data center 134 identifies a threat event, communication services 140 can provide emergency service notification and potentially SMS notifications to emergency service personnel and system participants.

It will be understood that in certain situations or locations with school 110, different crowd behavior is to be expected. For example, gym class or playgrounds can expect different behavior than inside classrooms. Similarly, certain assemblies or other school events or activities can be treated differently (e.g., a mass dispersal from the cafeteria could indicate a threat condition, or could simply indicate the end of lunch period). In one embodiment, system 100 includes geo-fencing or other mechanisms to treat information differently by the swarm analytics processing based on where the information is gathered or when the information is gathered, or a combination. Such data can be useful once and event is already identified and triggered, but system 100 can treat threat identification differently based on data from those areas or during certain times. Data at certain locations or certain times can selectively be not monitored, or can be monitored with different algorithmic considerations.

Figure 2:
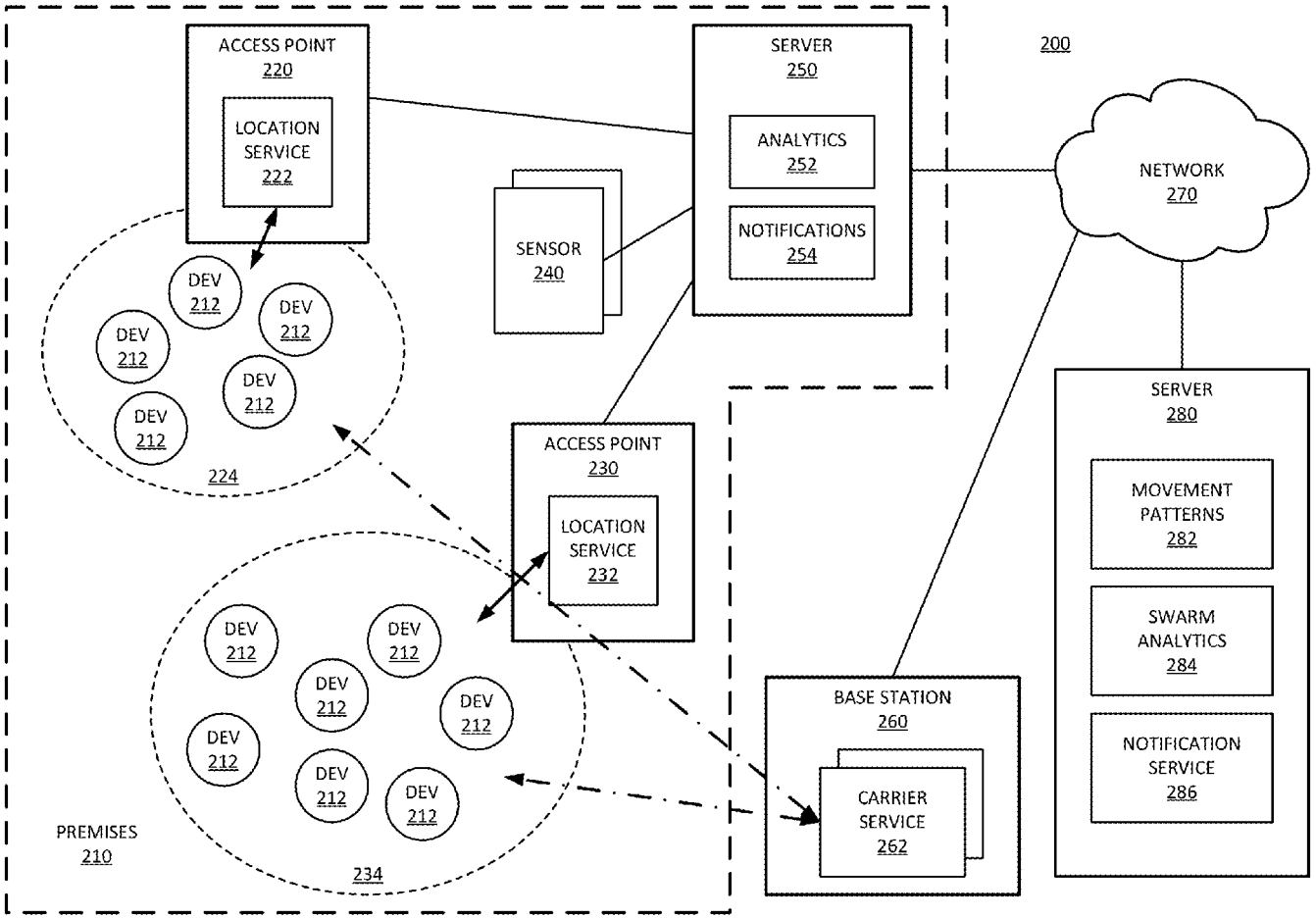
FIG. 2 is a block diagram of an embodiment of a system that performs threat monitoring with location services at on-premises access points.

FIG. 2 is a block diagram of an embodiment of a system that performs threat monitoring with location services at on-premises access points. System 200 provides on example of a threat monitoring system in accordance with system 100 of FIG. 1. System 200 can leverage the capabilities of mobile devices and pattern detection to compute information to send to first responders to allow faster identification of circumstances related to a threat condition, which can improve the response time to the threat.

Premises 200 represent a public area such as a school, a mall, sporting event venue, concert venue, or other large gathering of people. Premises 210 illustrates two groups of mobile devices (DEV) 212. It will be understood that mobile devices 212 can all be part of the same "group" or crowd, but are illustrated as separate sub-groups to indicate that different internal data gathering nodes may offer the best signal to certain devices. For example, premises 210 can include multiple access points, illustrated with accept points 220 and 230. It will be understood that a practical implementation of system 200 would typically include many more access points or routers or other internal network devices.

Access point 220 is illustrated to include location service 222, and access point 230 is illustrated to include location service 232. In one embodiment, location services 222 and 232 represent indoor location services provided by local area network signaling services. In one embodiment, location services 222 and 232 are enabled by computations performed by on-premises server 250. In one embodiment, access point 220 provides a best signal for mobile devices 212 in group 224. It will be understood that as a person moves throughout premises 210, they may change groups depending on proximity and signal strength to other access points. The devices in group 234 are primarily serviced by access point 230. In one embodiment, access points 220 and 230 provide location services at least in part by detection of signal strength from mobile devices 212. In one embodiment, locations services by access points 220 and 230 is either optional or not implemented, and location services can be provided by on-device hardware such as GPS hardware or through carrier service 262, or a combination.

In addition to location services provided by access points 220 and 230, or alternatively to such location services 222 and 232, mobile devices 212 can connect to one of multiple carrier services 262. Carrier service 262 represents a cellular carrier, which provides the phone and data services to mobile devices 212. It will be understood that while a single base station 260 is illustrated, multiple base stations could be in range of premises 210 to provide mobile service to mobile devices 212. In one embodiment, carrier service 262 can provide location service to network 270 for use in threat monitoring. In one embodiment, mobile devices 212 can provide GPS information over carrier service 262 to the threat monitoring system. In one embodiment, mobile devices 212 can provide GPS information to access points 220 and 230 for use in the threat monitoring system. In one embodiment, access points 220 and 230 use GPS information for gross measurement, and premises 210 includes location services in the access points (as illustrated) as finer measurement information. In one embodiment, premises 210 includes one or more other sensors 240 to provide more information. For example, sensors 240 can include motion detection sensors, gunshot sensors (sensors that "listen" for gunshots), other threat-detection sensing equipment, or other sensors.

In one embodiment, server 250 includes analytics 252. In one embodiment, server 250 merely compiles data, and all analytics are implemented by remote server 280. In one embodiment, server 250 includes one or more notification services 254. Such notifications 254 can include notifications to announcement systems (e.g., audio announcement systems, video boards, or other systems) on premises 210. Thus, threat detection can send a notification back to an automated system of premises 210 to enable the distribution of emergency information or other threat situation information. In one embodiment, notifications 254 can distribute threat condition information via an on-premises network (e.g., over a WiFi network) to mobile devices 212. In one embodiment, location services 222 and 232 register mobile devices 212 for location services or to otherwise participate in the threat monitoring system. Registration can be performed each time a user enters the premises. Registration can occur once or periodically (e.g., each semester). Registration can be "open" to allow a user to opt in or opt out at any time. In one embodiment, off-campus users can register over network 270 with server 250 or with server 280 or both.

As mentioned, server 250 can collect realtime location information for mobile device 212 via access points 220 and 230. In one embodiment, server 250 performs at least some processing on the data and sends it via network 270 to server 280, which represents a server off of premises 210. In one embodiment, server 250 simply collects data and sends it to server 280. Network 270 can represent a wide area network with commercial or public infrastructure or both. In one embodiment, network 270 can be wholly or partially controlled by the owner or occupant of premises 210. Network 270 includes routing or switching equipment or other equipment needed to transfer data to server 280.

In one embodiment, server 280 represents a data center or cloud processing service. In one embodiment, server 280 includes hardware resources dedicated to threat monitoring. In one embodiment, server 280 includes processes executing on shared hardware resources, which are shared with other processes that may or may not be related to threat monitoring. In one embodiment, server 280 includes movement patterns 282, which can represent stored movement patterns from previous location data. In one embodiment, movement patterns 282 include patterns identified by data for a location other than premises 210. For example, server 280 and other similar servers can generate threat detection models based on movement patterns and end results of whether a threat existed or not in the patterns, such as can be accomplished through neural networks and machine learning algorithms. Thus, in one embodiment, server 280 can perform processing on location data based on historical location data. In one embodiment, server 280 can perform processing on location data based on threat detection models.

Swarms analytics 284 represent services executed by server 280 to monitor premises 210 for a threat condition based on location data from mobile devices 212. An example of swarm analytics is explained with respect to FIG. 3. Briefly, swarm analytics 284 can determine from aggregated location and movement data general movement flows of crowds of people. Based on the movements, anomalies can be detected, such as multiple groups moving away from the same location, or most people moving away from certain locations but others not moving at all. Based on the computations on the location data, swarm analytics can identify likely threat conditions. In one embodiment, swarm analytics 284 can identify a location or an area of confidence where a threat is. In one embodiment, swarm analytics 284 can identify a location or an area of confidence where a victim or barricaded individual is.

Server 280 includes notification service 286 to report a threat condition in accordance with any embodiment described. Briefly, notification service 286 can notify emergency services or first responders. For example, notification service 286 can contact a '911' service, or a dispatch for first responders. As another example, notification service 286 can directly contact police, or fire department, or other emergency personnel, or a combination, with information about the locations of victims or a threat or both. In one embodiment, notification service 286 enables server 280 to share threat condition information with mobile devices 212, or other registered users or devices that might not be on location at premises 210.

Figure 3:
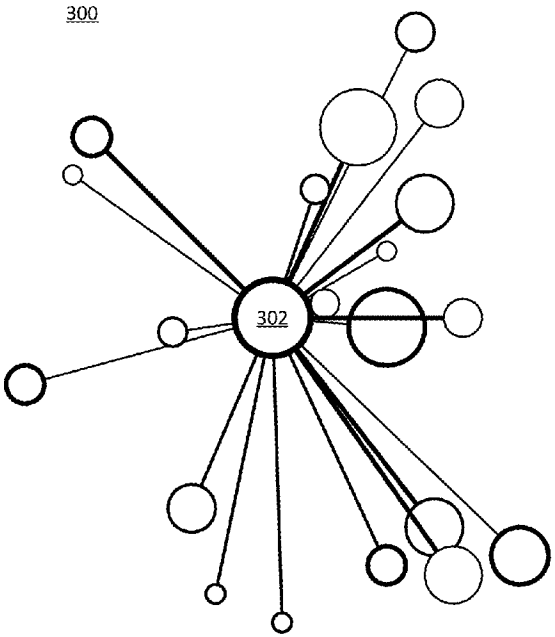
FIG. 3 is a diagrammatic representation of an embodiment of swarm analytics processing.

FIG. 3 is a diagrammatic representation of an embodiment of swarm analytics processing. Diagram 300 represents a crowd analytics model, or a swarm analytics model, or mass movement model. Diagram 300 could alternatively be considered a movement pattern model. People tend to follow predictable patterns based on the psychology of threat conditions. People who are far enough away from danger tend to increase their distance from danger. Thus, there can be an expectation of rapid movement away from a threat. People too close to danger will tend to hide. Thus, there can be an expectation of stationary movement nearest the threat.

Diagram 300 illustrates one example of how crowd analytics could be employed. A threat monitoring system as described for any embodiment herein can apply known analytical methods and model with existing methodologies applied to threat detection. A threat monitoring system can alternatively or additionally apply custom models and methodologies. Consider the example of diagram 300. Considering point 302 to be the threat, swarm analytics can measure the rate of which people move away from point 302. Point 302 can be identified as the potential threat by the fact that under normal conditions, there will not typically be a central point from which all other points are moving away. Once computations indicate increasing movement by other points away from point 302, point 302 can be considered a potential threat, or the origin of danger.

Swarm analytics can include weighting certain points in the diagram and weighting the "connection" lines, as illustrated very crudely in diagram 300 with different line weights. It will be understood that an actual implementation of swarm analytics can include much greater variation in data representation and processing techniques. In general, diagram 300 illustrates that swarm analytics can determine mathematically that point 302 is a likely threat. The system can then associate location information for point 302 (if known), or extrapolate location information based on the location information of the other points (more likely, since a threat is unlikely to want to broadcast location information). The location for point close to point 302 that have stopped moving away, for example, can be identified as potential victims or individuals trying to hide and needing more immediate attention from first responders.

Figure 4:
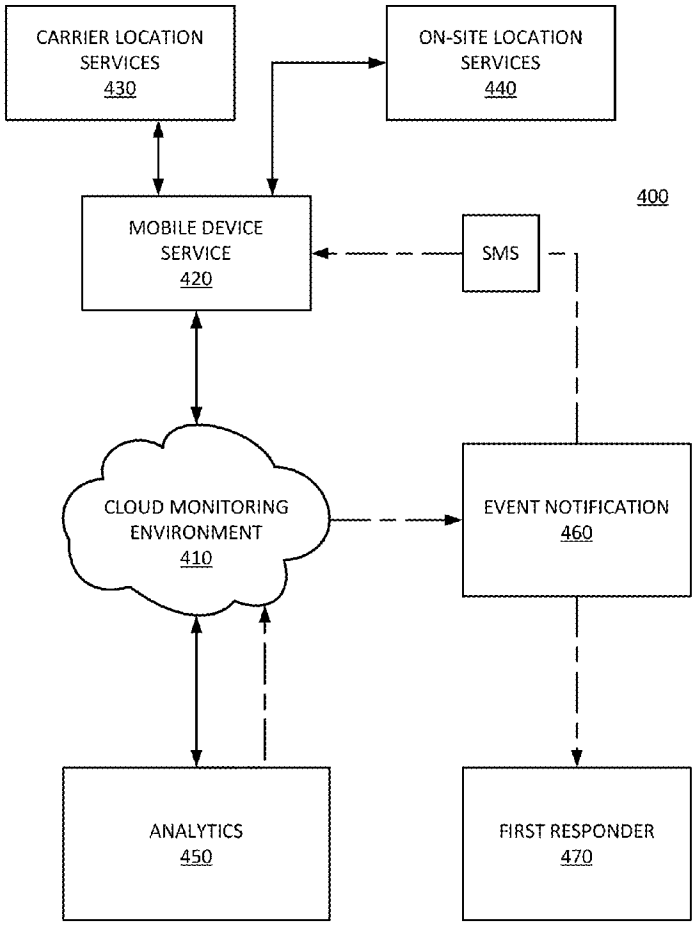
FIG. 4 is a block diagram of an embodiment of a threat monitoring services.

FIG. 4 is a block diagram of an embodiment of a threat monitoring services. System 400 provides an example of a threat monitoring system via the services implemented in the system, in accordance with any embodiment described herein. The solid lines represent the continual monitoring connections. The dashed lines represent the system response to the detection of a threat condition. System 400 includes cloud monitoring environment 410 to receive and process location data and perform swarm analytics or other movement modeling processing to identify potential threat conditions.

In one embodiment, system 400 includes multiple mobile device services 420, or a service for each mobile device that is part of the monitored environment. In one embodiment, as people enter the monitored premises, such as students coming onto the school campus, a service in their mobile device can register their location via GPS or other carrier location services 430. In one embodiment, the service on the phone is an application that a user installs on the phone. In one embodiment, the service on the phone is a service in the OS (operating system) of the mobile device. The collection of mobile devices becomes a swarm of sensors for the monitored premises via mobile device services 420. In one embodiment, one or more mobile device participate in on-site location service 440 from equipment located on-premises. Such a service 440 can include indoor location services in the case of an indoor monitored premises.

Cloud monitoring environment 410 represents one or more processing nodes and notification services accessible over a network. A server of environment 410 monitors the swarm of sensor data, performing computations that would indicate unusual behavior. Mobile device service 420 can be considered a consumer of carrier location services 430 and on-site location services 440. Mobile device service 420 uses these services to generate location information to send to environment 410. Thus, mobile device service 420 can tie the user to a specific location, which can be recorded by local processing or remote processing or both. In one embodiment, mobile device service 420 can leverage onboard sensors, such as accelerometers, to indicate rapid movement to environment 410.

In one embodiment, system 400 includes additional sensors (not specifically shown), which can provide additional data feeds environment 410 to support the computation of threat detection based on the location information. For example, in Central Park, the police have set up acoustic sensors to detect gunshots. Similar information could be used in system 400. While such additional information is not specific to swarm analytics detection, such sensor information could provide an event trigger to cause further analysis within the model. Other sensors can be involved in gathering information related to location information. Sensors such as video analysis using an Intel™ RealSense™ camera could offer additional input.

As illustrated in system 400, the data from data gathering nodes in the monitored system are fed into processing nodes, such as a cloud computing resource. In one embodiment, mobile device service 420 can include a web service interface to talk to the cloud via an on-premises server, while maintaining a secure connection. Such a secure connection can ensure privacy of information for the user. In one embodiment, cloud environment 410 includes cloud-based computational resources to enable the scaling of behind-the-scenes data centers based on the size of the premises, the number of users, or other factors. Analytics 450 represent the analytics performed by environment 410.

In one embodiment, execution of analytics indicates a threat event, as indicated by the dashed line from analytics 450 to environment 410. In one embodiment in response to a threat event, environment 410 dispatches information. Even notification 460 represents the dispatch or dissemination of information. In one embodiment, event notification 460 provides notification via SMS (text) or other service to mobile device services 420, which can provide information to people on-premises. Distribution of information to people on-premises can help individuals know that an event is taking place, and they should stay off-premises. For those on-premises, event notification 460 can provide information of the active event to help them reduce their risk. In one embodiment, event notification 460 provides threat event information to first responders 470. In one embodiment, such a notification can occur through a dedicated data feed, and can help determine if or how many medical units should be dispatched. In one embodiment, environment 410 can process and send notice of additional information for the owner or operator of the premises where the threat event is identified. Additional information can include notices such as the triggering of fire alarms, which can expand first responder response to fire department in addition to paramedics units and police.

Figure 5:
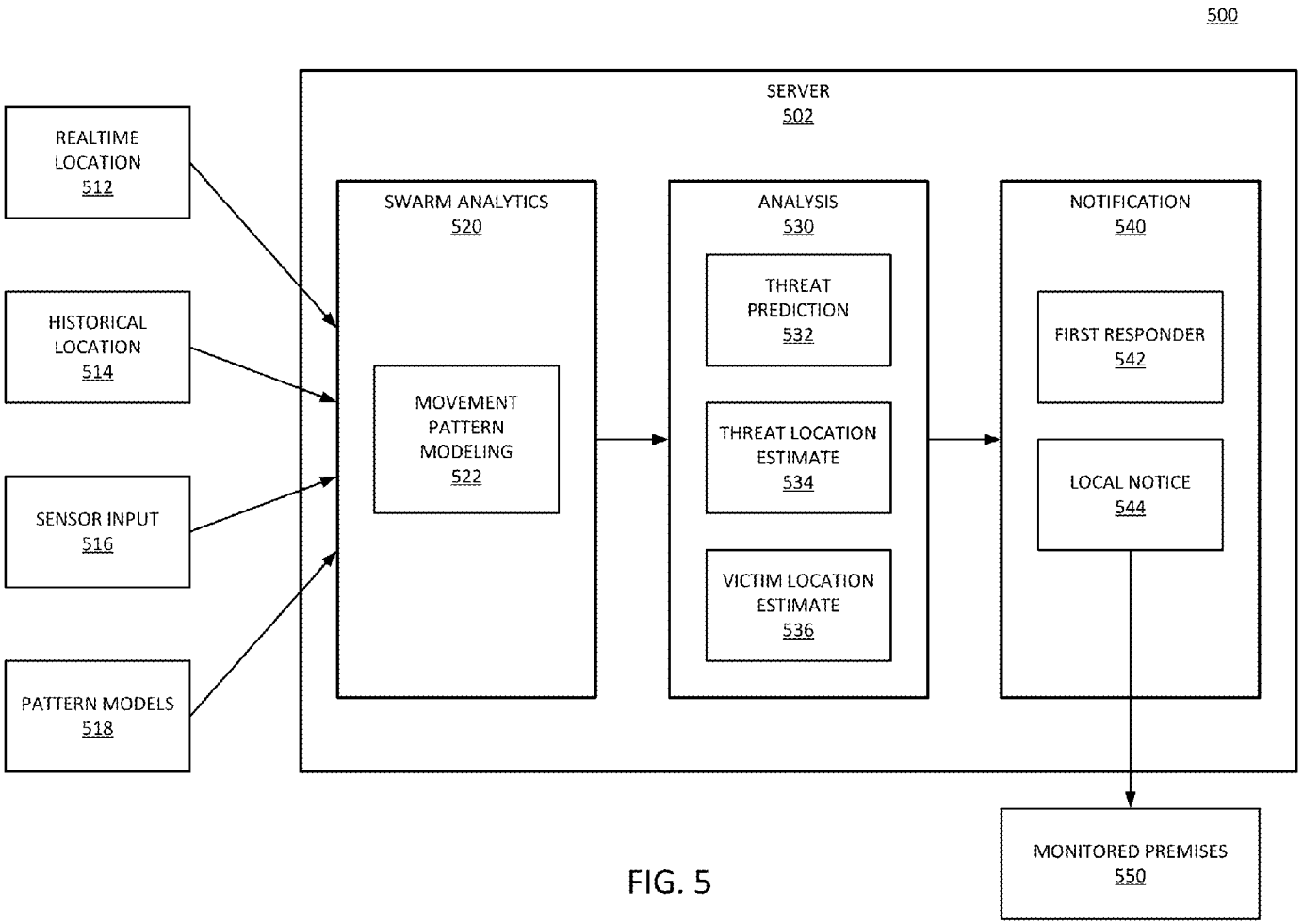
FIG. 5 is a block diagram of an embodiment of a processing node for threat monitoring.

FIG. 5 is a block diagram of an embodiment of a processing node for threat monitoring. System 500 provides an example of a processing environment, such as environment 410 of FIG. 4, which can be applied in accordance with any embodiment of threat monitoring described herein. System 500 includes one or more servers 502, which can include hardware and software resources to execute monitoring and threat detection operations.

Server 502 receives realtime location information 512 from multiple mobile devices, which location information can be treated as information from a swarm of sensors. In one embodiment, server 502 accesses historical location information 514, which can be stored locally to the server. In one embodiment, historical location information 514 is time-bounded information, such as enough information to indicate whether a particular mobile device is indicating movement or not. In one embodiment, server 502 receives sensor input 516 from on-premises sensors that monitor additional location information, or non-location information such as other threat conditions, or a combination. In one embodiment, server 502 accesses one or more pattern models 518, which represent models of threat conditions which can be compared to current calculations to determine a likelihood that a threat condition exists.

Server 502 includes swarm analytics 520 to perform processing of the input location data. Swarm analytics 520 may additionally perform processing based on non-location information, such as sensor input or movement pattern models. In one embodiment, swarm analytics 520 includes movement pattern modeling 522 to generate movement pattern models based on the location data. Such models can be saved as patterns models 518 for subsequent reference. Additional sensor input or indication of an actual threat event can inform the pattern models for accuracy of prediction.

In one embodiment, server 502 performs analysis on the processed location data to determine what is indicated. Analysis 530 can be considered part of swarm analytics, in one embodiment. Analysis 530 can specifically refer to computation of the likelihood of a threat event or threat condition and details about the condition, while swarm analytics 520 can be considered more the crunching of numbers on the location data. In one embodiment, analysis 530 can include threat prediction 532 based on a likelihood a threat condition is indicated by the data.

In one embodiment, analysis 530 can include threat location estimation 534, which is an estimate of a realtime location of the threat based on movement of the crowds. Thus, in one embodiment, server 502 can generate a likely location of a threat based on computed movement patterns. In one embodiment, analysis 530 can include victim location estimation 536, which represents an estimation of victims that are not moving away from the threat, indicating the possible need for medical attention or rescue. Thus, in one embodiment, server 502 can generate a likely location of a victim based on computed movement patterns.

Server 502 includes notification 540, which represents hardware and processes to send notification information about a detected threat. In one embodiment, notification 540 includes a connection to notify first responder 542. In one embodiment server 502 can provide details of the threat condition to the first responders, including details about likely location of the threat or victims or both. In one embodiment, notification 540 can include local notice 544, which represents notification to individuals associated with the premises at which the threat is detected. Thus, local notice 544 can include notification of the mobile devices of the users, as well as services to provide alert information to one or more announcement or information systems at monitored premises 550.

Figure 6A:
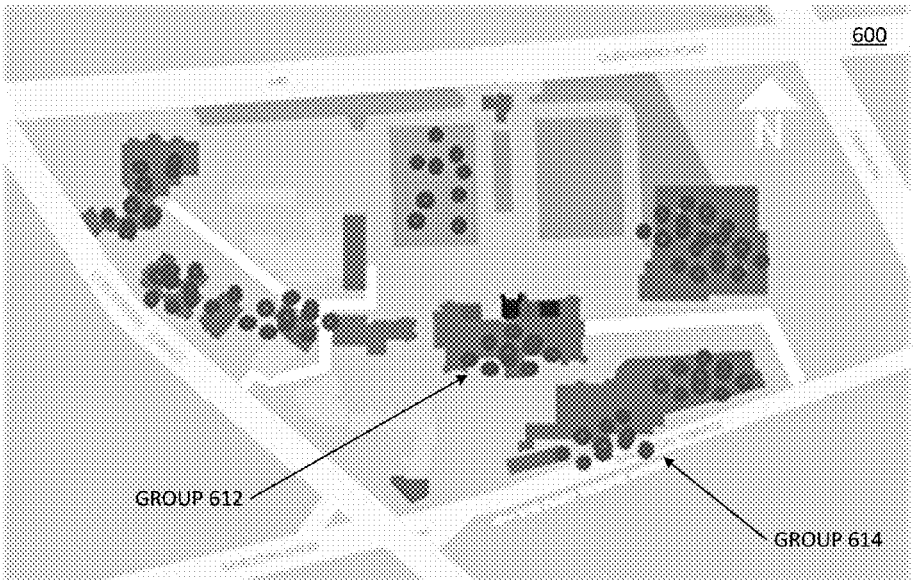
FIGS. 6A-6D are diagrammatic representations of an embodiment of an environment monitored with swarm analytics for a threat condition.

FIGS. 6A-6D are diagrammatic representations of an embodiment of an environment monitored with swarm analytics for a threat condition. FIG. 6A represents a healthy environment for premises 600. Premises 600 illustrates an example of a school environment with multiple different building where students and faculty are expected to be. Group 612 and group 614 both illustrate a close crowd of people in the buildings, without significant movement over time.

Figure 6B:
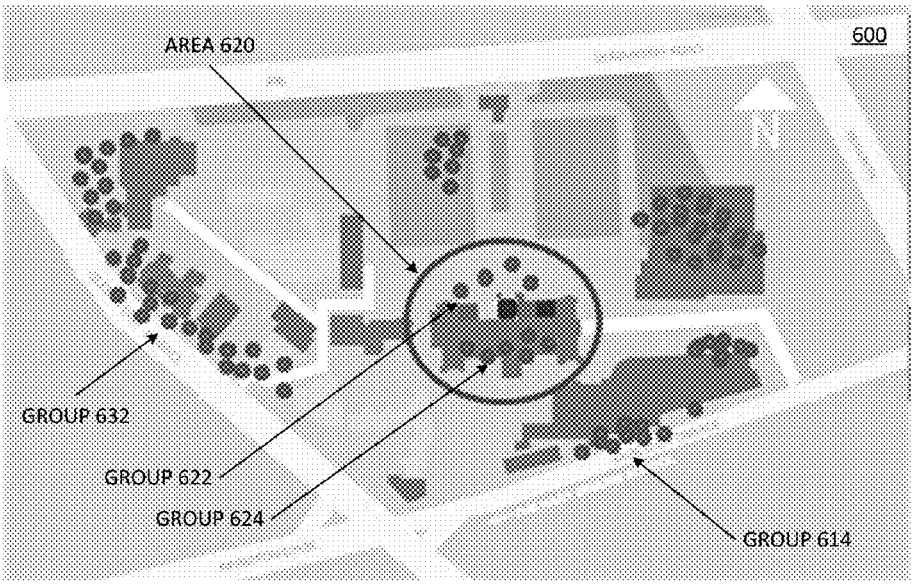

FIG. 6B represents premises 600 at the start of an event as the monitoring system detects a sudden massive shift in the environment. Notice in area 620 that group 612 has split into groups 622 and 624 moving different directions. The monitoring system swarm analytics can calculate such a drastic movement as a likelihood of a threat event, and a likelihood that area 620 has the source of the threat. Group 614 is moving away from area 620, as is group 632. The fact that all groups are moving away from a central area can be a strong indicator of the threat location.

Figure 6C:
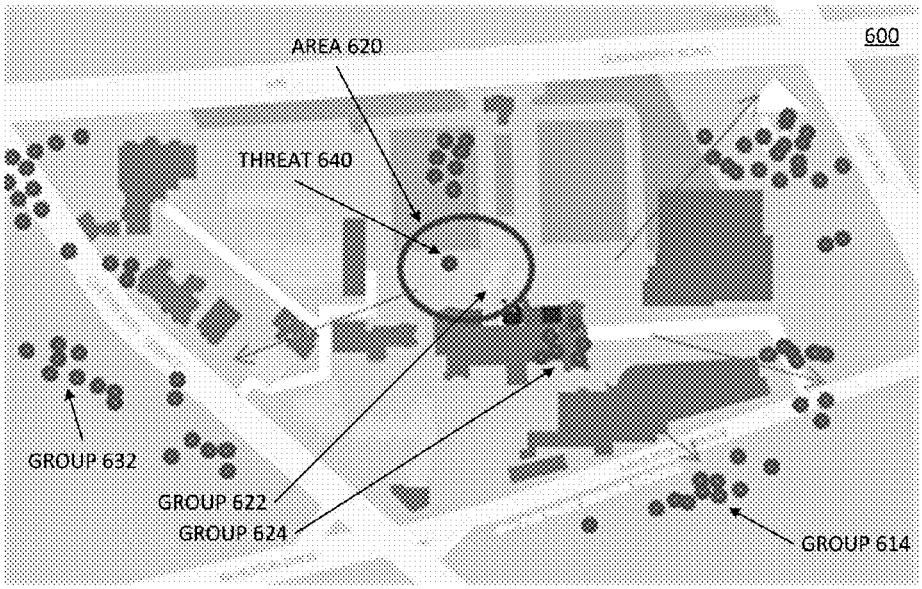

FIG. 6C represents premises 600 where the system can calculate the likelihood of a threat event with high confidence. Group 614 continues to move away from area 620, as does group 632 (and the other groups not specifically labeled). It will be observed that portions of group 622 do not shown movement away from the threat, which identifies possible victims. Additionally a portion of group 624 is also not moving away from the threat, but is stationary in the building where movement began. The system can identify these students as other potential victims or potentially in need of rescue. Based on all group movements, the system can calculate likely area 620 where threat 640 is located.

Figure 6D:
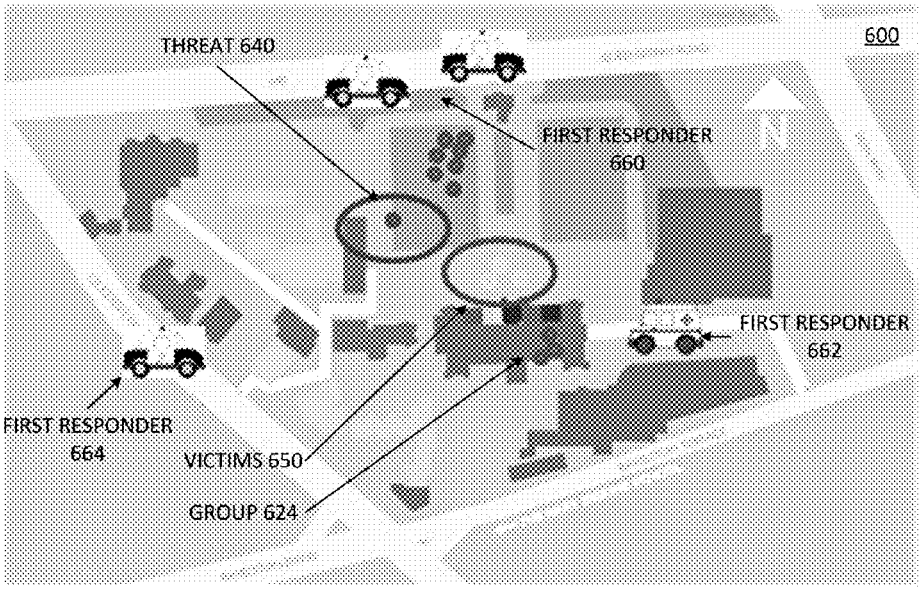

FIG. 6D represents premises 600 as first responders arrive to premises 600. Based on information provided by the monitoring system, police as represented by first responders 660 may be dispatched to the road near area 620 of premises 600 where threat 640 is predicted to be. First responder 664 may be dispatched to another side of premises 600 based on estimated movement of threat 640 as inferred from movement of the various groups. First responder 662 can include medical personnel dispatched closest to the portion of group 624 determined to be stationary, as well as victims 650 also determined to be stationary. These are the areas most likely needing medical assistance.

It will be understood that in accordance with these examples, police can use information from the monitoring system to identify a location of the threat with great confidence, enabling them to go immediately to an area most likely to confront the threat. This allows the deployment of police to areas most likely to provide proactive assistance to individuals still in danger on premises 600. Additionally, paramedics can immediately go to areas where there are most likely to be individuals needing medical attention. Seconds saved in response time by knowing exactly where to go can save lives.

Figure 7:
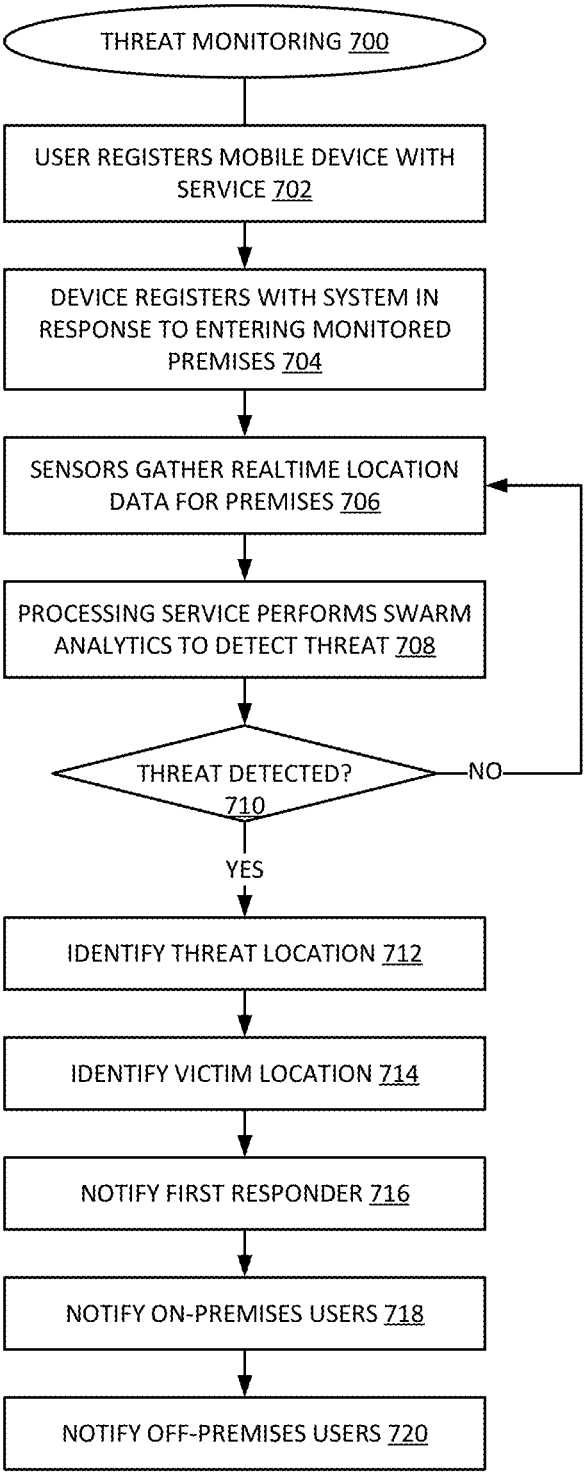
FIG. 7 is a flow diagram of an embodiment of a process for threat monitoring.

FIG. 7 is a flow diagram of an embodiment of a process for threat monitoring. Process 700 can be implemented by a threat monitoring system in accordance with any embodiment described herein, where a processing node receives location data and performs swarm analytics on the location data to determine a likelihood of a threat condition. In one embodiment, a user registers a mobile devices with the system, to enable one or more services to execute on the mobile device, 702. Such services can include notification services (to receive push notifications), as well as location services to provide location information.

In one embodiment, the device registers with one or more system nodes in response to entering the premises, 704. With the registration, the system can know that the mobile device is on-premises. In one embodiment, registration with the system on-premises enables the mobile device to provide location information to the system, and act as a sensor for the system. Other mobile devices will also be registered as sensors, or devices that generate location information to share with the processing node of the system. In one embodiment, the system includes one or more other sensors to gather other location information, movement information, threat detection information, or other sensors. The sensors gather realtime location data for the premises, 706. The sensors can potentially gather other data as well to help in analytics of the location data.

A processing service by on-premises processing resources or cloud-based processing resources, or both, performs swarm analytics on the gathered data to determine a likelihood of a threat, 708. If no threat is detected, 710 NO branch, the sensors can continue to gather data to be analyzed by the processing services (706, 708). If a threat is detected, 710 YES branch, in one embodiment, the processing service performs more detailed analysis of the threat condition.

In one embodiment, the processing service identifies a location of the threat, 712. In one embodiment, the processing service identifies a location of one or more victims, 714. Victims can be detected, for example, by looking for anomalies in movement data, such as not moving when other around them are all moving in the same direction. In one embodiment, the processing service accesses a notification service to notify a first responder of the threat condition or threat event, 716. In one embodiment, the system does not notify first responders until confirmation of the threat event by an indication from an administrator on-premises, or some other indication. In one embodiment, the notification service notifies on-premises users about the threat, 718. In one embodiment, the notification service notifies off-premises users of the system about the threat, 720.

Figure 8:
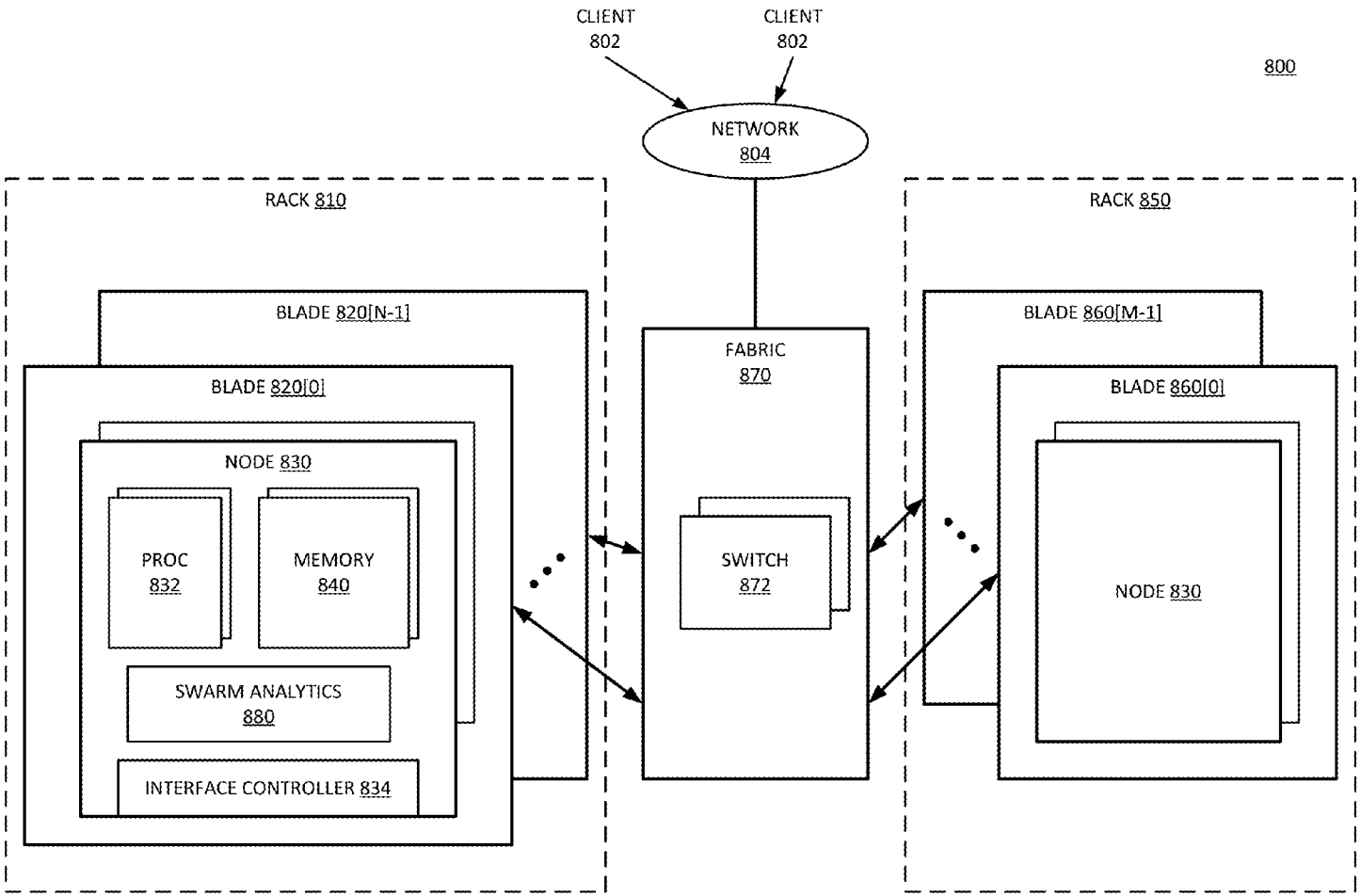
FIG. 8 is a block diagram of an embodiment of a multi-node network in which threat monitoring processing can be implemented.

FIG. 8 is a block diagram of an embodiment of a multi-node network in which threat monitoring processing can be implemented. System 800 represents a cloud server or a processing node in accordance with any cloud server described herein. In one embodiment, system 800 represents a data center. In one embodiment, system 800 represents a server farm. In one embodiment, system 800 represents a data cloud or a processing cloud.

One or more clients 802 make requests over network 804 to system 800. Network 804 represents one or more local networks, or wide area networks, or a combination. Clients 802 can be human or machine clients, which generate requests for the execution of operations by system 800. System 800 executes applications or data computation tasks requested by clients 802.

In one embodiment, system 800 includes one or more racks, which represent structural and interconnect resources to house and interconnect multiple computation nodes. In one embodiment, rack 810 includes multiple nodes 830. In one embodiment, rack 810 hosts multiple blade components 820. Hosting refers to providing power, structural or mechanical support, and interconnection. Blades 820 can refer to computing resources on printed circuit boards (PCBs), where a PCB houses the hardware components for one or more nodes 830. In one embodiment, blades 820 do not include a chassis or housing or other "box" other than that provided by rack 810. In one embodiment, blades 820 include housing with exposed connector to connect into rack 810. In one embodiment, system 800 does not include rack 810, and each blade 820 includes a chassis or housing that can stack or otherwise reside in close proximity to other blades and allow interconnection of nodes 830.

System 800 includes fabric 870, which represents one or more interconnectors for nodes 830. In one embodiment, fabric 870 includes multiple switches 872 or routers or other hardware to route signals among nodes 830. Additionally, fabric 870 can couple system 800 to network 804 for access by clients 802. In addition to routing equipment, fabric 870 can be considered to include the cables or ports or other hardware equipment to couples nodes 830 together. In one embodiment, fabric 870 has one or more associated protocols to manage the routing of signals through system 800. In one embodiment, the protocol or protocols is at least partly dependent on the hardware equipment used in system 800.

As illustrated, rack 810 includes N blades 820. In one embodiment, in addition to rack 810, system 800 includes rack 850. As illustrated, rack 850 includes M blades 860. M is not necessarily the same as N; thus, it will be understood that various different hardware equipment components could be used, and coupled together into system 800 over fabric 870. Blades 860 can be the same or similar to blades 820. Nodes 830 can be any type of node as described herein, and are not necessarily all the same type of node. System 800 is not limited to being homogenous, nor is it limited to not being homogenous.

For simplicity, only the node in blade 820[0] is illustrated in detail. However, other nodes in system 800 can be the same or similar. At least some nodes 830 are computation nodes, with processor 832 and memory 840. A computation node refers to a node with processing resources (e.g., one or more processors) that executes an operating system and can receive and process one or more tasks. In one embodiment, at least some nodes 830 are storage server nodes with a server as processing resources 832 and memory 840. A storage server refers to a node with more storage resources than a computation node, and rather than having processors for the execution of tasks, a storage server includes processing resources to manage access to the storage nodes within the storage server.

In one embodiment, node 830 includes interface controller 834, which represents logic to control access by node 830 to fabric 870. The logic can include hardware resources to interconnect to the physical interconnection hardware. The logic can include software or firmware logic to manage the interconnection. In one embodiment, interface controller 834 is or includes a host fabric interface (HFI). Node 830 includes memory subsystem 840, which provides storage services for data to be computed by processors 832. Processor 832 can include one or more separate processors. Each separate processor can include a single processing unit, a multicore processing unit, or a combination. The processing unit can be a primary processor such as a CPU (central processing unit), a peripheral processor such as a GPU (graphics processing unit), or a combination. Memory 840 can be or include memory devices and a memory controller.

Reference to memory devices can apply to different memory types. Memory devices generally refer to volatile memory technologies. Volatile memory is memory whose state (and therefore the data stored on it) is indeterminate if power is interrupted to the device. Nonvolatile memory refers to memory whose state is determinate even if power is interrupted to the device. Dynamic volatile memory requires refreshing the data stored in the device to maintain state. One example of dynamic volatile memory includes DRAM (dynamic random access memory), or some variant such as synchronous DRAM (SDRAM). A memory subsystem as described herein may be compatible with a number of memory technologies, such as DDR3 (dual data rate version 3, original release by JEDEC (Joint Electronic Device Engineering Council) on Jun. 27, 2007, currently on release 21), DDR4 (DDR version 4, initial specification published in September 2012 by JEDEC), DDR4E (DDR version 4, extended, currently in discussion by JEDEC), LPDDR3 (low power DDR version 3, JESD209-3B, August 2013 by JEDEC), LPDDR4 (LOW POWER DOUBLE DATA RATE (LPDDR) version 4, JESD209-4, originally published by JEDEC in August 2014), WI02 (Wide I/O 2 (WideIO2), JESD229-2, originally published by JEDEC in August 2014), HBM (HIGH BANDWIDTH MEMORY DRAM, JESD235, originally published by JEDEC in October 2013), DDR5 (DDR version 5, currently in discussion by JEDEC), LPDDR5 (currently in discussion by JEDEC), HBM2 (HBM version 2), currently in discussion by JEDEC), or others or combinations of memory technologies, and technologies based on derivatives or extensions of such specifications.

In addition to, or alternatively to, volatile memory, in one embodiment, reference to memory devices can refer to a nonvolatile memory device whose state is determinate even if power is interrupted to the device. In one embodiment, the nonvolatile memory device is a block addressable memory device, such as NAND or NOR technologies. Thus, a memory device can also include a future generation nonvolatile devices, such as a three dimensional crosspoint (3DXP) memory device, other byte addressable nonvolatile memory devices, or memory devices that use chalcogenide phase change material (e.g., chalcogenide glass). In one embodiment, the memory device can be or include multi-threshold level NAND flash memory, NOR flash memory, single or multi-level phase change memory (PCM) or phase change memory with a switch (PCMS), a resistive memory, nanowire memory, ferroelectric transistor random access memory (FeTRAM), magnetoresistive random access memory (MRAM) memory that incorporates memristor technology, or spin transfer torque (STT)-MRAM, or a combination of any of the above, or other memory.

In one embodiment, node 830 includes swarm analytics 880, which can include threat monitoring processing in accordance with any embodiment described herein. Swarm analytics 880 can be executed by processor 832 on data stored in memory 840. Either an access point or the mobile devices themselves can be data node client 802 to provide location data to node 830 for processing of swarm analytics 880. Based on computations by swarm analytics 880, node 830 can generate notification information to be send via fabric 870 over network 804 to first responders or to other individuals, or both.

Figure 9:
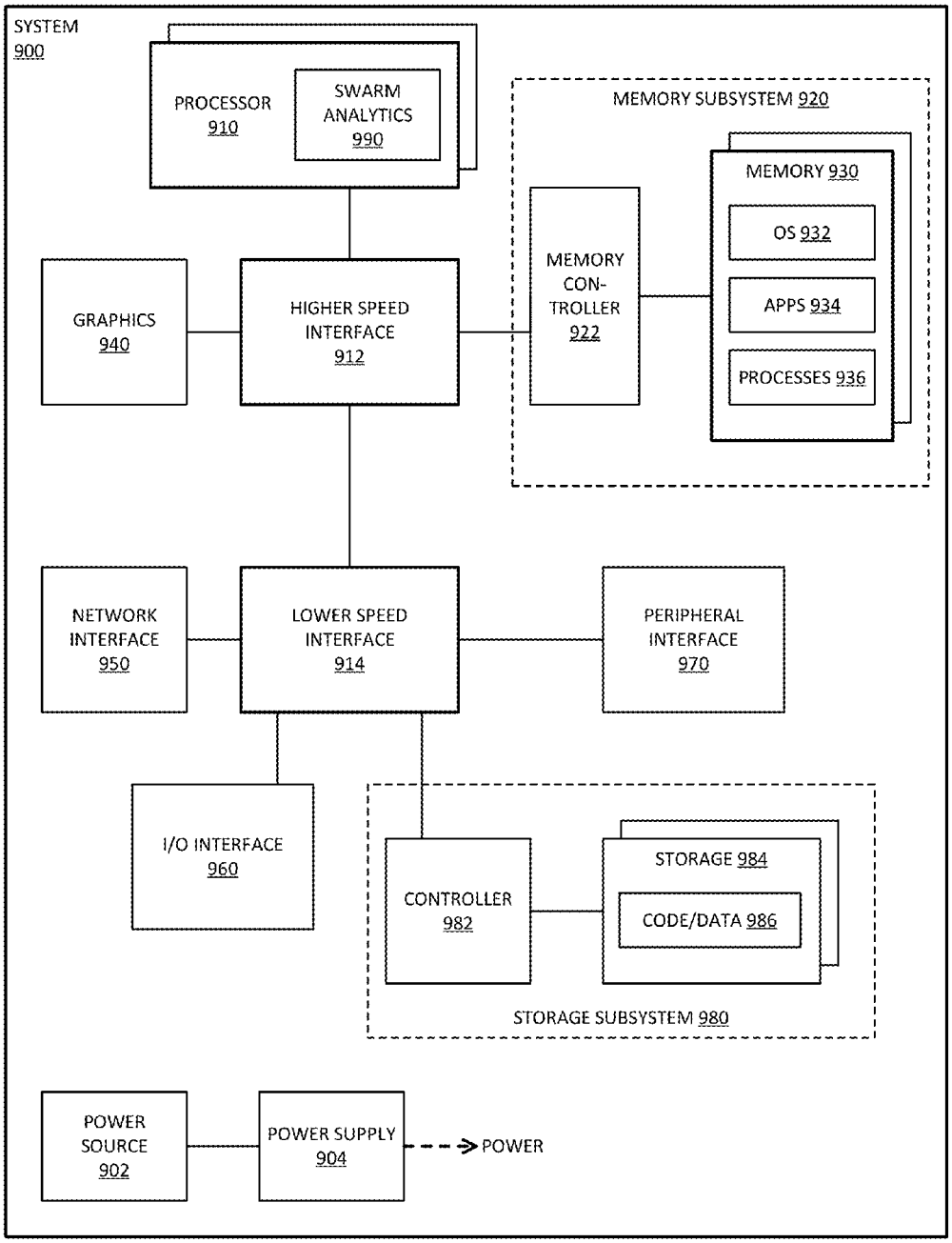
FIG. 9 is a block diagram of an embodiment of a computing system for a multi-node network in which threat monitoring processing can be implemented.

FIG. 9 is a block diagram of an embodiment of a computing system for a multi-node network in which threat monitoring processing can be implemented. System 900 represents a computing device in accordance with any embodiment described herein, and can be a node in a network of nodes. System 900 can thus represent a blade server, or a computation node of a blade (in an implementation where a blade includes multiple nodes), or a storage server, or other computational node. System 900 includes memory resources as described in more detail below.

System 900 includes processor 910, which provides processing, operation management, and execution of instructions for system 900. Processor 910 can include any type of microprocessor, central processing unit (CPU), graphics processing unit (GPU), processing core, or other processing hardware to provide processing for system 900, or a combination of processors. Processor 910 controls the overall operation of system 900, and can be or include, one or more programmable general-purpose or special-purpose microprocessors, digital signal processors (DSPs), programmable controllers, application specific integrated circuits (ASICs), programmable logic devices (PLDs), or the like, or a combination of such devices.

In one embodiment, system 900 includes interface 912 coupled to processor 910, which can represent a higher speed interface or a high throughput interface for system components that needs higher bandwidth connections, such as memory subsystem 920 or graphics interface components 940. Interface 912 can represent a "north bridge" circuit, which can be a standalone component or integrated onto a processor die. Graphics interface 940 interfaces to graphics components for providing a visual display to a user of system 900. In one embodiment, graphics interface 940 generates a display based on data stored in memory 930 or based on operations executed by processor 910 or both.

Memory subsystem 920 represents the main memory of system 900, and provides storage for code to be executed by processor 910, or data values to be used in executing a routine. Memory subsystem 920 can include one or more memory devices 930 such as read-only memory (ROM), flash memory, one or more varieties of random access memory (RAM), or other memory devices, or a combination of such devices. Memory 930 stores and hosts, among other things, operating system (OS) 932 to provide a software platform for execution of instructions in system 900. Additionally, applications 934 can execute on the software platform of OS 932 from memory 930. Applications 934 represent programs that have their own operational logic to perform execution of one or more functions. Processes 936 represent agents or routines that provide auxiliary functions to OS 932 or one or more applications 934 or a combination. OS 932, applications 934, and processes 936 provide logic to provide functions for system 900. In one embodiment, memory subsystem 920 includes memory controller 922, which is a memory controller to generate and issue commands to memory 930. It will be understood that memory controller 922 could be a physical part of processor 910 or a physical part of interface 912. For example, memory controller 922 can be an integrated memory controller, integrated onto a circuit with processor 910.

While not specifically illustrated, it will be understood that system 900 can include one or more buses or bus systems between devices, such as a memory bus, a graphics bus, interface buses, or others. Buses or other signal lines can communicatively or electrically couple components together, or both communicatively and electrically couple the components. Buses can include physical communication lines, point-to-point connections, bridges, adapters, controllers, or other circuitry or a combination. Buses can include, for example, one or more of a system bus, a Peripheral Component Interconnect (PCI) bus, a HyperTransport or industry standard architecture (ISA) bus, a small computer system interface (SCSI) bus, a universal serial bus (USB), or an Institute of Electrical and Electronics Engineers (IEEE) standard 1394 bus (commonly referred to as "Firewire").

In one embodiment, system 900 includes interface 914, which can be coupled to interface 912. Interface 914 can be a lower speed interface than interface 912. In one embodiment, interface 914 can be a "south bridge" circuit, which can include standalone components and integrated circuitry. In one embodiment, multiple user interface components or peripheral components, or both, couple to interface 914. Network interface 950 provides system 900 the ability to communicate with remote devices (e.g., servers or other computing devices) over one or more networks. Network interface 950 can include an Ethernet adapter, wireless interconnection components, USB (universal serial bus), or other wired or wireless standards-based or proprietary interfaces. Network interface 950 can exchange data with a remote device, which can include sending data stored in memory or receiving data to be stored in memory.

In one embodiment, system 900 includes one or more input/output (I/O) interface(s) 960. I/O interface 960 can include one or more interface components through which a user interacts with system 900 (e.g., audio, alphanumeric, tactile/touch, or other interfacing). Peripheral interface 970 can include any hardware interface not specifically mentioned above. Peripherals refer generally to devices that connect dependently to system 900. A dependent connection is one where system 900 provides the software platform or hardware platform or both on which operation executes, and with which a user interacts.

In one embodiment, system 900 includes storage subsystem 980 to store data in a nonvolatile manner. In one embodiment, in certain system implementations, at least certain components of storage 980 can overlap with components of memory subsystem 920. Storage subsystem 980 includes storage device(s) 984, which can be or include any conventional medium for storing large amounts of data in a nonvolatile manner, such as one or more magnetic, solid state, or optical based disks, or a combination. Storage 984 holds code or instructions and data 986 in a persistent state (i.e., the value is retained despite interruption of power to system 900). Storage 984 can be generically considered to be a "memory," although memory 930 is typically the executing or operating memory to provide instructions to processor 910. Whereas storage 984 is nonvolatile, memory 930 can include volatile memory (i.e., the value or state of the data is indeterminate if power is interrupted to system 900). In one embodiment, storage subsystem 980 includes controller 982 to interface with storage 984. In one embodiment controller 982 is a physical part of interface 914 or processor 910, or can include circuits or logic in both processor 910 and interface 914.

Power source 902 provides power to the components of system 900. More specifically, power source 902 typically interfaces to one or multiple power supplies 904 in system 902 to provide power to the components of system 900. In one embodiment, power supply 904 includes an AC to DC (alternating current to direct current) adapter to plug into a wall outlet. Such AC power can be renewable energy (e.g., solar power) power source 902. In one embodiment, power source 902 includes a DC power source, such as an external AC to DC converter. In one embodiment, power source 902 or power supply 904 includes wireless charging hardware to charge via proximity to a charging field. In one embodiment, power source 902 can include an internal battery or fuel cell source.

In one embodiment, system 900 includes swarm analytics 990 to be executed by processor 910. Swarm analytics 990 can include threat monitoring processing in accordance with any embodiment described herein. Swarm analytics 990 can be executed by processor 910 on data stored in memory subsystem 920. Either an access point or the mobile devices themselves can be data node to provide location data to system 900 for processing of swarm analytics 990. Based on computations by swarm analytics 990, system 900 can generate notification information to be send via network interface 950 to first responders or to other individuals, or both. In one embodiment, system 900 is part of a network of computers in a cloud computing environment. In one embodiment, system 900 represents a server on-premises at a monitored environment.

Figure 10:
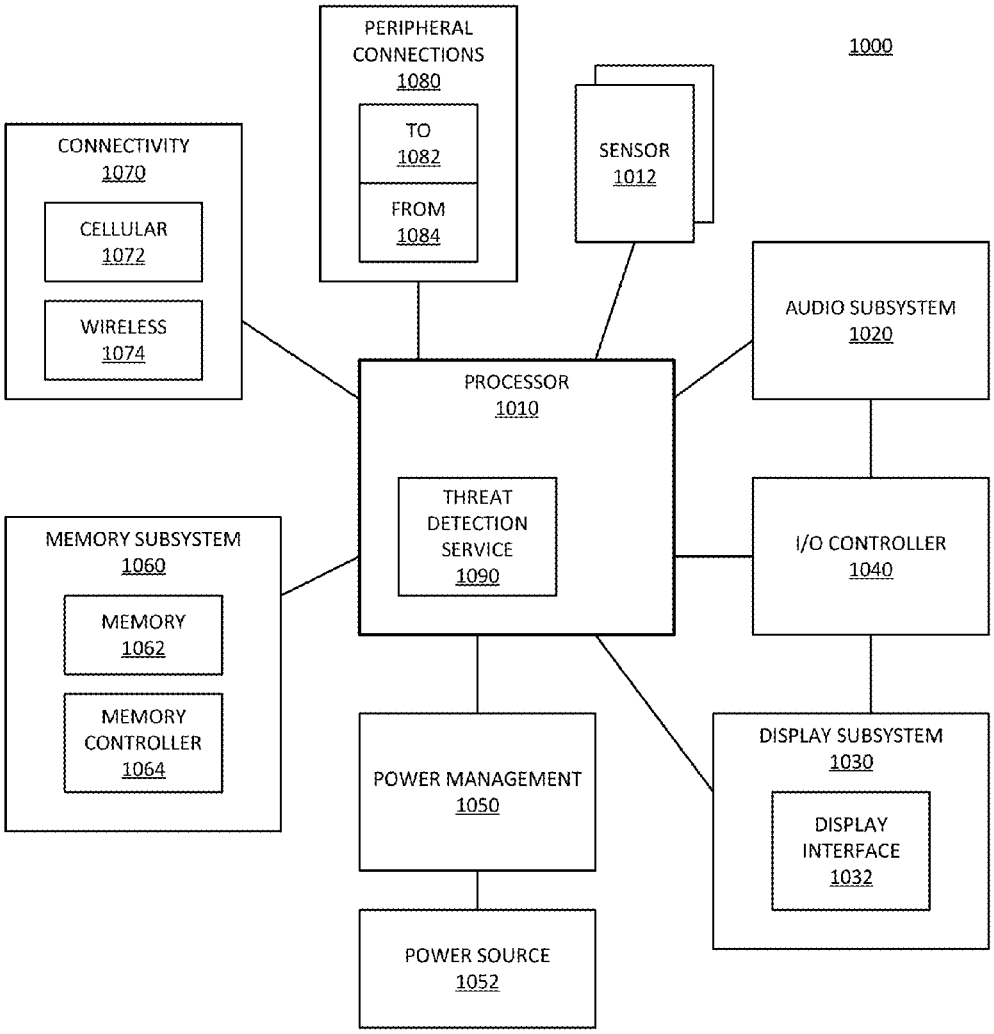
FIG. 10 is a block diagram of an embodiment of a mobile device in which a threat monitoring service can be implemented.

FIG. 10 is a block diagram of an embodiment of a mobile device in which a threat monitoring service can be implemented. Device 1000 represents a mobile computing device, such as a computing tablet, a mobile phone or smartphone, a wireless-enabled e-reader, wearable computing device, or other mobile device, or an embedded computing device. It will be understood that certain of the components are shown generally, and not all components of such a device are shown in device 1000.

Device 1000 includes processor 1010, which performs the primary processing operations of device 1000. Processor 1010 can include one or more physical devices, such as microprocessors, application processors, microcontrollers, programmable logic devices, or other processing means. The processing operations performed by processor 1010 include the execution of an operating platform or operating system on which applications and device functions are executed. The processing operations include operations related to I/O (input/output) with a human user or with other devices, operations related to power management, operations related to connecting device 1000 to another device, or a combination. The processing operations can also include operations related to audio I/O, display I/O, or other interfacing, or a combination. Processor 1010 can execute data stored in memory. Processor 1010 can write or edit data stored in memory.

In one embodiment, system 1000 includes one or more sensors 1012. Sensors 1012 represent embedded sensors or interfaces to external sensors, or a combination. Sensors 1012 enable system 1000 to monitor or detect one or more conditions of an environment or a device in which system 1000 is implemented. Sensors 1012 can include environmental sensors (such as temperature sensors, motion detectors, light detectors, cameras, chemical sensors (e.g., carbon monoxide, carbon dioxide, or other chemical sensors)), pressure sensors, accelerometers, gyroscopes, medical or physiology sensors (e.g., biosensors, heart rate monitors, or other sensors to detect physiological attributes), or other sensors, or a combination. Sensors 1012 can also include sensors for biometric systems such as fingerprint recognition systems, face detection or recognition systems, or other systems that detect or recognize user features. Sensors 1012 should be understood broadly, and not limiting on the many different types of sensors that could be implemented with system 1000. In one embodiment, one or more sensors 1012 couples to processor 1010 via a frontend circuit integrated with processor 1010. In one embodiment, one or more sensors 1012 couples to processor 1010 via another component of system 1000.

In one embodiment, device 1000 includes audio subsystem 1020, which represents hardware (e.g., audio hardware and audio circuits) and software (e.g., drivers, codecs) components associated with providing audio functions to the computing device. Audio functions can include speaker or headphone output, as well as microphone input. Devices for such functions can be integrated into device 1000, or connected to device 1000. In one embodiment, a user interacts with device 1000 by providing audio commands that are received and processed by processor 1010.

Display subsystem 1030 represents hardware (e.g., display devices) and software components (e.g., drivers) that provide a visual display for presentation to a user. In one embodiment, the display includes tactile components or touchscreen elements for a user to interact with the computing device. Display subsystem 1030 includes display interface 1032, which includes the particular screen or hardware device used to provide a display to a user. In one embodiment, display interface 1032 includes logic separate from processor 1010 (such as a graphics processor) to perform at least some processing related to the display. In one embodiment, display subsystem 1030 includes a touchscreen device that provides both output and input to a user. In one embodiment, display subsystem 1030 includes a high definition (HD) display that provides an output to a user. High definition can refer to a display having a pixel density of approximately 100 PPI (pixels per inch) or greater, and can include formats such as full HD (e.g., 1080p), retina displays, 4K (ultra high definition or UHD), or others. In one embodiment, display subsystem 1030 generates display information based on data stored in memory and operations executed by processor 1010.

I/O controller 1040 represents hardware devices and software components related to interaction with a user. I/O controller 1040 can operate to manage hardware that is part of audio subsystem 1020, or display subsystem 1030, or both. Additionally, I/O controller 1040 illustrates a connection point for additional devices that connect to device 1000 through which a user might interact with the system. For example, devices that can be attached to device 1000 might include microphone devices, speaker or stereo systems, video systems or other display device, keyboard or keypad devices, or other I/O devices for use with specific applications such as card readers or other devices.

As mentioned above, I/O controller 1040 can interact with audio subsystem 1020 or display subsystem 1030 or both. For example, input through a microphone or other audio device can provide input or commands for one or more applications or functions of device 1000. Additionally, audio output can be provided instead of or in addition to display output. In another example, if display subsystem includes a touchscreen, the display device also acts as an input device, which can be at least partially managed by I/O controller 1040. There can also be additional buttons or switches on device 1000 to provide I/O functions managed by I/O controller 1040.

In one embodiment, I/O controller 1040 manages devices such as accelerometers, cameras, light sensors or other environmental sensors, gyroscopes, global positioning system (GPS), or other hardware that can be included in device 1000, or sensors 1012. The input can be part of direct user interaction, as well as providing environmental input to the system to influence its operations (such as filtering for noise, adjusting displays for brightness detection, applying a flash for a camera, or other features).

In one embodiment, device 1000 includes power management 1050 that manages battery power usage, charging of the battery, and features related to power saving operation. Power management 1050 manages power from power source 1052, which provides power to the components of system 1000. In one embodiment, power source 1052 includes an AC to DC (alternating current to direct current) adapter to plug into a wall outlet. Such AC power can be renewable energy (e.g., solar power, motion based power). In one embodiment, power source 1052 includes only DC power, which can be provided by a DC power source, such as an external AC to DC converter. In one embodiment, power source 1052 includes wireless charging hardware to charge via proximity to a charging field. In one embodiment, power source 1052 can include an internal battery or fuel cell source.

Memory subsystem 1060 includes memory device(s) 1062 for storing information in device 1000. Memory subsystem 1060 can include nonvolatile (state does not change if power to the memory device is interrupted) or volatile (state is indeterminate if power to the memory device is interrupted) memory devices, or a combination. Memory 1060 can store application data, user data, music, photos, documents, or other data, as well as system data (whether long-term or temporary) related to the execution of the applications and functions of system 1000. In one embodiment, memory subsystem 1060 includes memory controller 1064 (which could also be considered part of the control of system 1000, and could potentially be considered part of processor 1010). Memory controller 1064 includes a scheduler to generate and issue commands to memory device 1062.

Connectivity 1070 includes hardware devices (e.g., wireless or wired connectors and communication hardware, or a combination of wired and wireless hardware) and software components (e.g., drivers, protocol stacks) to enable device 1000 to communicate with external devices. The external device could be separate devices, such as other computing devices, wireless access points or base stations, as well as peripherals such as headsets, printers, or other devices. In one embodiment, system 1000 exchanges data with an external device for storage in memory or for display on a display device. The exchanged data can include data to be stored in memory, or data already stored in memory, to read, write, or edit data.

Connectivity 1070 can include multiple different types of connectivity. To generalize, device 1000 is illustrated with cellular connectivity 1072 and wireless connectivity 1074. Cellular connectivity 1072 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, LTE (long term evolution—also referred to as "4G"), or other cellular service standards. Wireless connectivity 1074 refers to wireless connectivity that is not cellular, and can include personal area networks (such as Bluetooth), local area networks (such as WiFi), or wide area networks (such as WiMax), or other wireless communication, or a combination. Wireless communication refers to transfer of data through the use of modulated electromagnetic radiation through a non-solid medium. Wired communication occurs through a solid communication medium.

Peripheral connections 1080 include hardware interfaces and connectors, as well as software components (e.g., drivers, protocol stacks) to make peripheral connections. It will be understood that device 1000 could both be a peripheral device ("to" 1082) to other computing devices, as well as have peripheral devices ("from" 1084) connected to it. Device 1000 commonly has a "docking" connector to connect to other computing devices for purposes such as managing (e.g., downloading, uploading, changing, synchronizing) content on device 1000. Additionally, a docking connector can allow device 1000 to connect to certain peripherals that allow device 1000 to control content output, for example, to audiovisual or other systems.

In addition to a proprietary docking connector or other proprietary connection hardware, device 1000 can make peripheral connections 1080 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other type.

In one embodiment, system 1000 represents a mobile device that participates as a sensor node in a threat monitoring system. In one embodiment, processor 1010 executes threat detection service 1090, which can represent a service provided via an application or via a service of an operating system of system 1000. Threat detection service 1090 provides location information to the threat monitoring system, such as via connectivity 1070. In one embodiment, threat detection service 1090 enables system 1000 to receive threat condition information from the threat monitoring system when a threat is detected. In one embodiment, system 1000 represents a mobile device of a first responder that receives threat condition information, which can include information about threat location and victim location, among other data.

In one aspect, a system includes: one or more data nodes to gather realtime location data for multiple mobile devices; and a processing node to receive the realtime location data from the one or more data nodes and perform swarm analytics processing on the realtime location data to determine if movement patterns for the mobile devices indicate a likely threat condition for the crowd, and to notify a first responder of the threat condition.

In one embodiment, the data nodes comprise a cellular carrier base station. In one embodiment, the data nodes comprise a wireless access point on-premises at a location of the crowd. In one embodiment, further comprising one or more wireless access points to register mobile devices to provide location services to the mobile devices. In one embodiment, further comprising: one or more sensors on-premises at a location of the crowd, the sensors to include threat-detection sensing equipment; wherein the processing node to receive the threat-detection sensing equipment from the one or more sensors. In one embodiment, the processing node comprises a network processing node off-premises from a location of the crowd, and further comprising a local processing node on-premises at the location, the local processing node to receive the realtime location data from one or more data nodes, perform data processing on the realtime location data, and send the processed data to the network node. In one embodiment, the processing node to identify a likely location of a threat based on the determined movement patterns, and notify the first responder of the likely location of the threat. In one embodiment, the processing node to identify a likely location of a victim based on the determined movement patterns, and notify the first responder of the likely location of the victim. In one embodiment, the processing node is further to send threat information to one or more mobile devices associated with the crowd of people.

In one aspect, a method includes: gathering realtime location data for multiple mobile devices of a crowd of people; performing swarm analytics processing on the realtime location data to determine if movement patterns for the mobile devices indicate a likely threat condition for the crowd; and notifying a first responder of the threat condition.

In one embodiment, gathering the realtime location data comprises gathering data from a cellular carrier base station. In one embodiment, gathering the realtime location data comprises gathering data from a wireless access point on-premises at a location of the crowd. In one embodiment, further comprising: registering one or more one or more mobile device with the wireless access points, for the wireless access points to provide location services to the mobile devices. In one embodiment, further comprising: gathering threat detection information from one or more threat-detection sensors on-premises at a location of the crowd. In one embodiment, performing swarm analytics processing comprises processing by a network node off-premises from a location of the crowd. In one embodiment, performing the swarm analytics processing comprises identifying a likely location of a threat based on the determined movement patterns, and notify the first responder of the likely location of the threat. In one embodiment, performing the swarm analytics processing comprises identifying a likely location of a victim based on the determined movement patterns, and notify the first responder of the likely location of the victim. In one embodiment, further comprising: sending threat information to one or more mobile devices associated with the crowd of people.

In one aspect, an article of manufacture comprising a computer readable storage medium having content stored thereon, which when accessed by a machine, causes the execution of operations to perform a method in accordance with any embodiment of the preceding paragraphs. In one aspect, an apparatus comprising means for performing a method in accordance with any embodiment of the preceding paragraphs.

In one aspect, a mobile device includes: hardware to determine a location of the mobile device; and a processor to execute a threat detection service, the threat detection service to send location information for the mobile device for swarm analytics processing by a processing node to determine based on the location information for the mobile device and other mobile devices if movement patterns for the mobile devices indicate a likely threat condition for a crowd, and to notify a first responder of the threat condition.

In one embodiment, the hardware to determine the location of the mobile device comprises a global positioning system (GPS) sensor. In one embodiment, the hardware to determine the location of the mobile device comprises a wireless network transceiver to receive location information from a wireless access point network. In one embodiment, the threat detection service is to register with a network of access points on premises of a location of the crowd. In one embodiment, the threat detection service further to receive a threat indication from the processing node. In one embodiment, the processing node comprises a network processing node off-premises from a location of the crowd. In one embodiment, the processor is to send location information via a cellular carrier base station. In one embodiment, the processor is to send location information via a wireless access point on-premises at a location of the crowd.

Flow diagrams as illustrated herein provide examples of sequences of various process actions. The flow diagrams can indicate operations to be executed by a software or firmware routine, as well as physical operations. In one embodiment, a flow diagram can illustrate the state of a finite state machine (FSM), which can be implemented in hardware, software, or a combination. Although shown in a particular sequence or order, unless otherwise specified, the order of the actions can be modified. Thus, the illustrated embodiments should be understood only as an example, and the process can be performed in a different order, and some actions can be performed in parallel. Additionally, one or more actions can be omitted in various embodiments; thus, not all actions are required in every embodiment. Other process flows are possible.

To the extent various operations or functions are described herein, they can be described or defined as software code, instructions, configuration, data, or a combination. The content can be directly executable ("object" or "executable" form), source code, or difference code ("delta" or "patch" code). The software content of the embodiments described herein can be provided via an article of manufacture with the content stored thereon, or via a method of operating a communication interface to send data via the communication interface. A machine readable storage medium can cause a machine to perform the functions or operations described, and includes any mechanism that stores information in a form accessible by a machine (e.g., computing device, electronic system, etc.), such as recordable/non-recordable media (e.g., read only memory (ROM), random access memory (RAM), magnetic disk storage media, optical storage media, flash memory devices, etc.). A communication interface includes any mechanism that interfaces to any of a hardwired, wireless, optical, etc., medium to communicate to another device, such as a memory bus interface, a processor bus interface, an Internet connection, a disk controller, etc. The communication interface can be configured by providing configuration parameters or sending signals, or both, to prepare the communication interface to provide a data signal describing the software content. The communication interface can be accessed via one or more commands or signals sent to the communication interface.

Various components described herein can be a means for performing the operations or functions described. Each component described herein includes software, hardware, or a combination of these. The components can be implemented as software modules, hardware modules, special-purpose hardware (e.g., application specific hardware, application specific integrated circuits (ASICs), digital signal processors (DSPs), etc.), embedded controllers, hardwired circuitry, etc.

Besides what is described herein, various modifications can be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. A system, comprising:

a wireless communication device to gather realtime location data for mobile devices in a monitored area and communicatively coupled with the wireless communication device; and a backend server device to receive the realtime location data for the mobile devices from the wireless communication device and perform swarm analytics processing on collective realtime location data of the mobile devices to determine if a change in movement patterns for the mobile devices as a group, including movement away from a central point, indicate a threat condition in the monitored area, and to automatically notify a first responder in response to detection of the threat condition based on the movement patterns for the mobile devices.

2. The system of claim 1, wherein the wireless communication device comprises a cellular carrier base station.

3. The system of claim 1, wherein the wireless communication device comprises a wireless access point local to the monitored area.

4. The system of claim 3, wherein the wireless access point is to register one or more of the mobile devices to provide location services to the mobile devices, and report the realtime location data to the backend server device.

5. The system of claim 1, further comprising:

a sensor local to the monitored area including threat-detection sensing equipment to detect a threat indicator independent of the movement patterns for the mobile devices;

wherein the threat-detection sensing equipment is to provide the threat indicator to the backend server device.

6. The system of claim 1, wherein the backend server device comprises a cloud server off-premises from the monitored area, and further comprising a local server device local to the monitored area to receive the realtime location data from the wireless communication device, perform data processing on the realtime location data, and send the processed data to the cloud server.

7. The system of claim 1, wherein the backend server device is to estimate a location of the threat condition based on the movement patterns, and notify the first responder of the estimated location.

8. The system of claim 1, wherein the backend server device is to estimate a location of a victim based on the movement patterns, and notify the first responder of the estimated location of the victim.

9. The system of claim 1, wherein the backend server device is further to send threat information to at least one of the mobile devices in the monitored area.

10. A method, comprising:

gathering realtime location data for mobile devices of a crowd of people in a monitored area with a wireless communication device communicatively coupled with the mobile devices and which provides location services to the mobile devices;

performing swarm analytics processing on collective realtime location data of the mobile devices to determine if a change in movement patterns for the mobile devices as a group, including movement away from a central point, indicate a threat condition for the crowd in the monitored area; and notifying a first responder automatically in response to detection of the threat condition based on the movement patterns for the mobile devices.

11. The method of claim 10, wherein gathering the realtime location data comprises gathering data from a cellular carrier base station.

12. The method of claim 10, wherein gathering the realtime location data comprises gathering data from a wireless access point on-premises in the monitored area.

13. The method of claim 12, further comprising:

registering the mobile devices with the wireless access point, for the wireless access point to provide location services to the mobile devices.

14. The method of claim 10, further comprising:

gathering threat detection information from one or more threat-detection sensors on-premises in the monitored area.

15. The method of claim 10, wherein performing swarm analytics processing comprises processing by a cloud server device off-premises from the monitored area.

16. The method of claim 10, wherein performing the swarm analytics processing comprises estimating a location of the threat condition based on the determined change in movement patterns, and notifying the first responder of the estimated location of the threat.

17. The method of claim 10, wherein performing the swarm analytics processing comprises estimating a location of a victim based on the determined change in movement patterns, and notifying the first responder of the estimated location of the victim.

18. The method of claim 10, further comprising:

sending threat information from a server device to at least one of the mobile devices in the monitored area.

* * * * *